US005823008A

United States Patent [19]

Nikai et al.

[11] Patent Number: 5,823,008

[45] Date of Patent: Oct. 20, 1998

[54] COLD AIR SUPPLY UNIT

[75] Inventors: Isao Nikai; Motohisa Uda, both of Yokohama; Naoki Shindo, Hino; Takeshi Fuse, Ayase, all of Japan

[73] Assignees: Kajima Corporation, Tokyo; NHK Spring Co., Ltd., Kanagawa, both of Japan

[21] Appl. No.: 647,941

[22] PCT Filed: Oct. 4, 1995

[86] PCT No.: PCT/JP95/02031

§ 371 Date: Jul. 19, 1996

§ 102(e) Date: Jul. 19, 1996

[87] PCT Pub. No.: WO96/11367

PCT Pub. Date: Apr. 18, 1996

[30] Foreign Application Priority Data

| | | | |
|---|---|---|---|
| May 10, 1994 | [JP] | Japan | 6-264417 |
| Oct. 5, 1994 | [JP] | Japan | 6-241045 |
| Oct. 5, 1994 | [JP] | Japan | 6-264407 |

[51] Int. Cl.[6] ..... F25D 9/00

[52] U.S. Cl. ..... 62/401; 62/408; 62/86; 62/87

[58] Field of Search ..... 62/401, 402, 406, 62/407, 408, 86, 87

[56] References Cited

U.S. PATENT DOCUMENTS

| | | | |
|---|---|---|---|
| 5,642,629 | 7/1997 | Ohman | 62/401 |

FOREIGN PATENT DOCUMENTS

| | | |
|---|---|---|
| 54-54961 | 4/1979 | Japan . |
| 56-37499 | 4/1981 | Japan . |
| 58-19689 | 2/1983 | Japan . |
| 64-54683 | 4/1989 | Japan . |
| 1-21195 | 6/1989 | Japan . |
| 3-204596 | 9/1991 | Japan . |
| 6-207755 | 7/1994 | Japan . |

*Primary Examiner*—Harold Joyce
*Assistant Examiner*—Pamela A. O'Connor
*Attorney, Agent, or Firm*—McDermott, Will & Emery

[57] ABSTRACT

A mobile cold air supply unit which comprises, as housed in a single casing, an air compressor-expander constituted of an integral combination of a motor, an air compressor and an air expander, an air-to-water heat exchanger and an air-to-air heat exchanger, is furnished in the casing with air tubing for interconnecting the aforesaid components at an air pressure not higher than 5 kg/cm$^2$, and is provided with a cold air discharge connection, a return air intake connection, a cooling water outlet connection and a cooling water intake connection.

12 Claims, 15 Drawing Sheets

COLD AIR SUPPLY UNIT

TECHNICAL FIELD

This invention relates to a mobile cold air supply unit, more particularly to a compact low-temperature air generator with relatively low internal pressure that is freely usable for supplying a facility requiring ice making or a facility requiring cooling with cold air at around minus 5° C.–minus 45° C. at around 1.0–1.1 atm, that is, at a pressure near normal atmospheric pressure.

BACKGROUND ART

The conventional ordinary refrigerating cycle is configured to utilize Freon, ammonia or the like as the refrigerant and the refrigerant is circulated in a closed cycle. The Freon refrigerants most commonly used are environment-destroying substances and require a high pressure on the order of 15–20 kg/cm$^2$ for establishing the refrigerating cycle. The refrigerator and the pump unit are therefore configured based on specifications that stress leak and pressure proofing of the entire system. Various types with such specifications are in practical use.

On the other hand, technologies are known for obtaining low-temperature air without use of an environment-destroying substance like Freon, by compressing and cooling totally harmless air itself and then adiabatically expanding it to obtain low-temperature air. For example, technologies have been proposed in JPA-5-113258, JPA-6-213521, JPB-59-52343 etc. regarding improved compressors and expanders for this purpose, in JPA-6-34212 and JPA-5-223377 regarding improved separation of water from the treated air, in JPA-63-315866, JPA-5-231732, JPA-5-223375, JPA-2-97850 etc. regarding apparatus control, and in JPA-6-207755, JPA-6-213521 etc. regarding heat recovery.

OBJECT OF THE INVENTION

In the construction of ice rinks, bobsleigh facilities and other such winter sports facilities and in such refrigerated storage fields as refrigerated storage units, containers and the like, whether stationary or mobile, it is desirable to achieve the cooling without use of Freon. While the air-type cooling systems proposed in the aforesaid publications each has its own special features, none of such air-type cooling systems has been actually utilized in the construction of such facilities. In short, no economical packaged air-type cold air supply unit which is freely portable to the construction site and usable by anyone has been commercially available.

This invention therefore aims at overcoming this problem by providing a packaged cold air supply unit capable of supplying low-temperature (minus 5° C.–minus 45° C.) air at near normal atmospheric pressure at any location where air and water are available or, in some cases, where air, water and electricity are available.

DISCLOSURE OF THE INVENTION

The present invention provides a mobile cold air supply unit which essentially comprises, as housed in a single casing, an air compressor-expander constituted of an integral combination of a motor, an air compressor and an air expander, an air-to-water heat exchanger and an air-to-air heat exchanger, is furnished in the casing with air tubing for interconnecting the aforesaid components at an air pressure not higher than 5 kg/cm$^2$, preferably not higher than 3 kg/cm$^2$ and more preferably not higher than 2 kg/cm$^2$, and is provided with a cold air discharge connection, a return air intake connection, a cooling water outlet connection and a cooling water intake connection.

The air compressor-expander is an integrated unit in which the shaft of the motor is connected through gearing with the shaft of the air compressor and the shaft of the air expander. The motor, which is for imparting rotational power, can be an electric motor or an internal combustion engine. The air compressor is preferably a single-suction, single-stage blower turbocompressor and the air expander is preferably a single-stage centrifugal turbine. In this integrated air compressor-expander, the work of the air expander is recovered as a reduction of the motor power. The power recovery rate is about 50% at maximum and ordinarily 42–45%. While a single air compressor is sufficient, division into two units is also possible.

The air-to-water heat exchanger exchanges heat between the air discharged from the air compressor and water supplied from outside the unit. An ordinary fin-and-tube-plate heat exchanger is used, with the water passed on the tube-plate side.

The air-to-air heat exchanger exchanges heat between air leaving the air-to-water heat exchanger and the air entering the air compressor. It is a resin plate-type heat exchanger constituted by stacking corrugated resin heat exchanger plates. More specifically, the air-to-air heat exchanger utilizes the resin heat exchanging surfaces of a large number of stacked corrugated resin plates, with one air flow being passed through air passages formed between adjacent corrugated plates of the stack and the other air flow being passed through air passages adjacent to these air passages. In order to form a large number of fine air passages between the wave lines in the stack of corrugated resin plates, the corrugated plates are stacked so that their wave lines cross or lie in parallel. Preferably, the fine air passages are formed to have approximately square cross sections and twisted tapes are inserted therein. The stack of corrugated resin plates is installed in the heat exchanger casing with an elastic resin sheet disposed between itself and the inner surface of the casing.

Since the pressure of the air passing between the components of the cold air supply unit of this invention is 5 kg/cm$^2$ at maximum and is ordinarily about 2 kg/cm$^2$ at the highest points, resin tubes can be used for the air tubing connecting the components. It is also possible to use spiral ducts or the like commonly used as air conditioning ducts. To facilitate the explanation, the specification and drawings express air pressure in units of kg/cm$^2$ and atm. Strictly speaking, 1 atm=1.033 kg/cm$^2$.

BEST MODE FOR CARRYING OUT THE INVENTION

The invention will be explained in detail with reference to the attached drawings.

Figure 1:
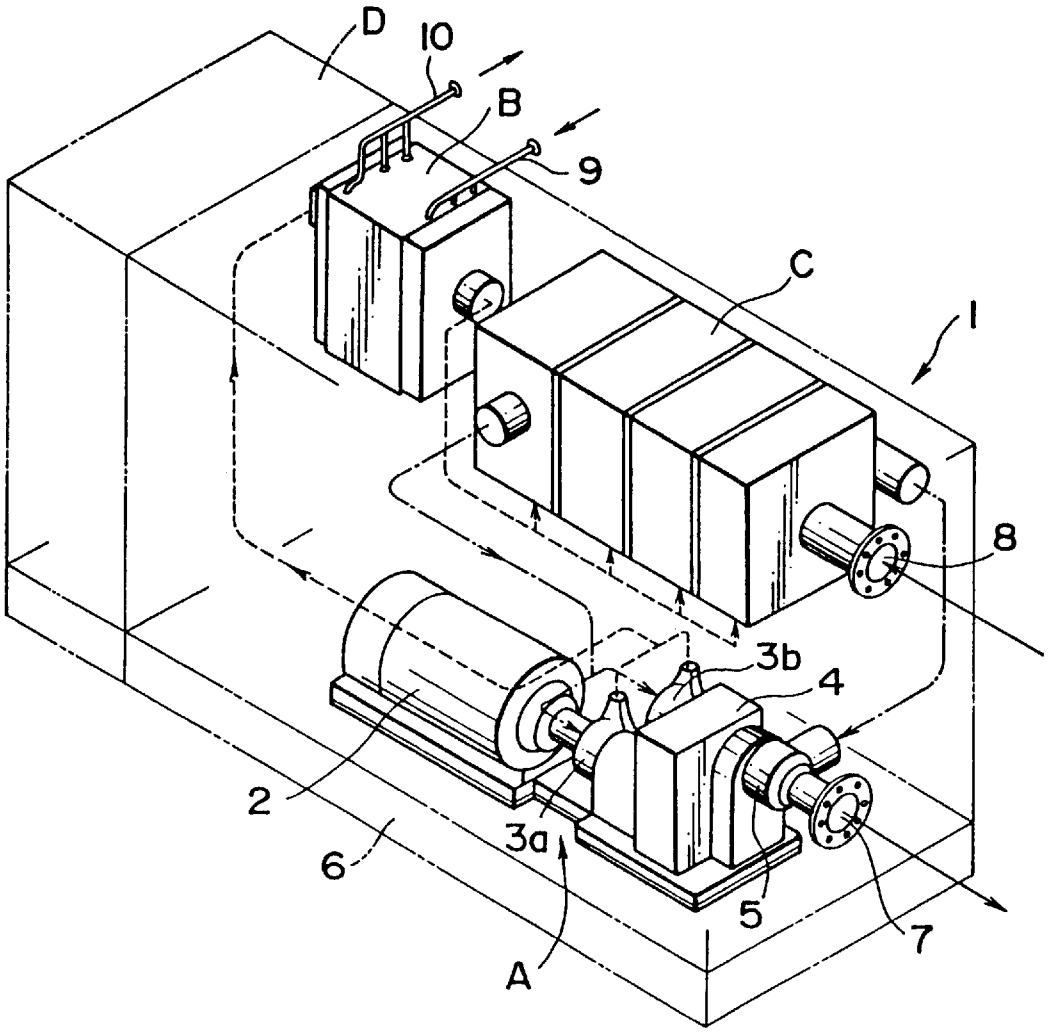
FIG. 1 is a perspective view showing an embodiment of the packaged cold air supply unit according to the invention.

FIG. 1 is a perspective view showing an embodiment of the packaged cold air supply unit according to the invention. For easy understanding, the tubing lines inside the unit are shown systematically by use of broken lines. The unit has a rectangular box-shaped casing 1 in which an air compressor-expander A integrally combining an electric motor 2 serving as a power source, a compressor 3 (two units 3*a* and 3*b* in this embodiment) and an expander 5 is installed on a casing floor plate 6, an air-to-water heat exchanger B and an air-to-air heat exchanger C are disposed in the upper space in the casing 1, and air tubing for air pressure of not higher than 5 kg/cm$^2$ (indicated by broken lines) is connected between these components. In addition, a cold air discharge connection 7, a return air intake connection 8, a cooling water intake connection 9 and a cooling water outlet connection 10 are provided on the outside of the casing 1.

An optional box D for housing a control panel can be provided on one side of the unit depending on the purpose for which the unit is used. The control panel includes, for example, equipment for invertor control of the air compressor-expander, a temperature controller, a humidity controller, a pressure controller, an airflow controller, a power unit and the like, none of which are shown in the figure.

The cold air supply unit of FIG. 1 has a refrigerating performance rated at 10 tons of refrigeration and the capacity to deliver −20° C. cold air from the cold air discharge connection 7 at 1.5 kg/sec. Its casing is 2.4 m high, 1.5 m deep and 3.5 m wide. It is a self-contained stand-alone unit that can be transported by truck.

Figure 2:
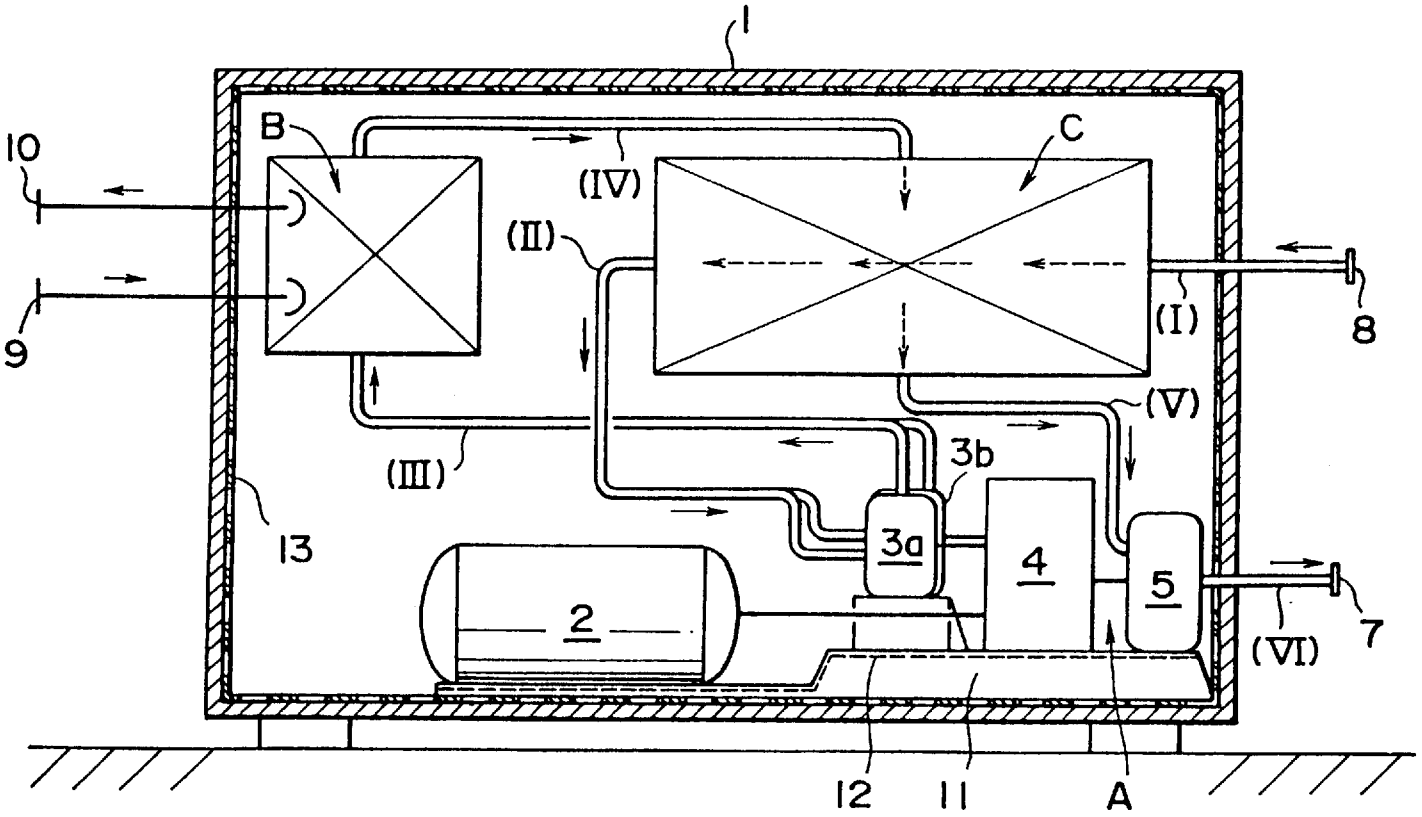
FIG. 2 is a simplified sectional view of the unit of FIG. 1.

FIG. 2 is a simplified sectional view of the unit of FIG. 1 illustrating how the components housed therein are interconnected. The reference symbols in the figure have the same meaning as those explained concerning FIG. 1. As can be seen in this figure, the air taken into the unit through the return air intake connection 8 passes through a line (I) into the air-to-air heat exchanger C and after leaving the air-to-air heat exchanger C passes through a line (II) into the compressors 3*a*, 3*b*. From the compressors 3*a*, 3*b*, it passes through a line (III) to the air-to-water heat exchanger B and then passes through a line (IV) into the air-to-air heat exchanger C, through a line (V) into the expander 5 and through a line (VI) to the cold air discharge connection 7.

Among the lines (I)–(VI), those with the highest pressures are the lines (III), (IV) and (V) between the compressor 3 and the expander 5. However, since even in these the pressure reaches only about 2 atm (about 2 kg/cm$^2$) at the highest in this unit, the lines can be constituted of resin tubes. The other tubes (I), (II) and (VI) are under around 1 atm, at most about 1.2 atm, of pressure and are also made of resin.

The integrated air compressor-expander A is installed on a mounting plate 11 via a vibro-isolating sheet 12, and the inner surface of the casing 1 is completely covered with a noise absorption sheet 13. Although not visible in the figure, the casing 1 is provided with an inspection door and with louvers for discharging heat generated inside the casing 1.

Figure 3:
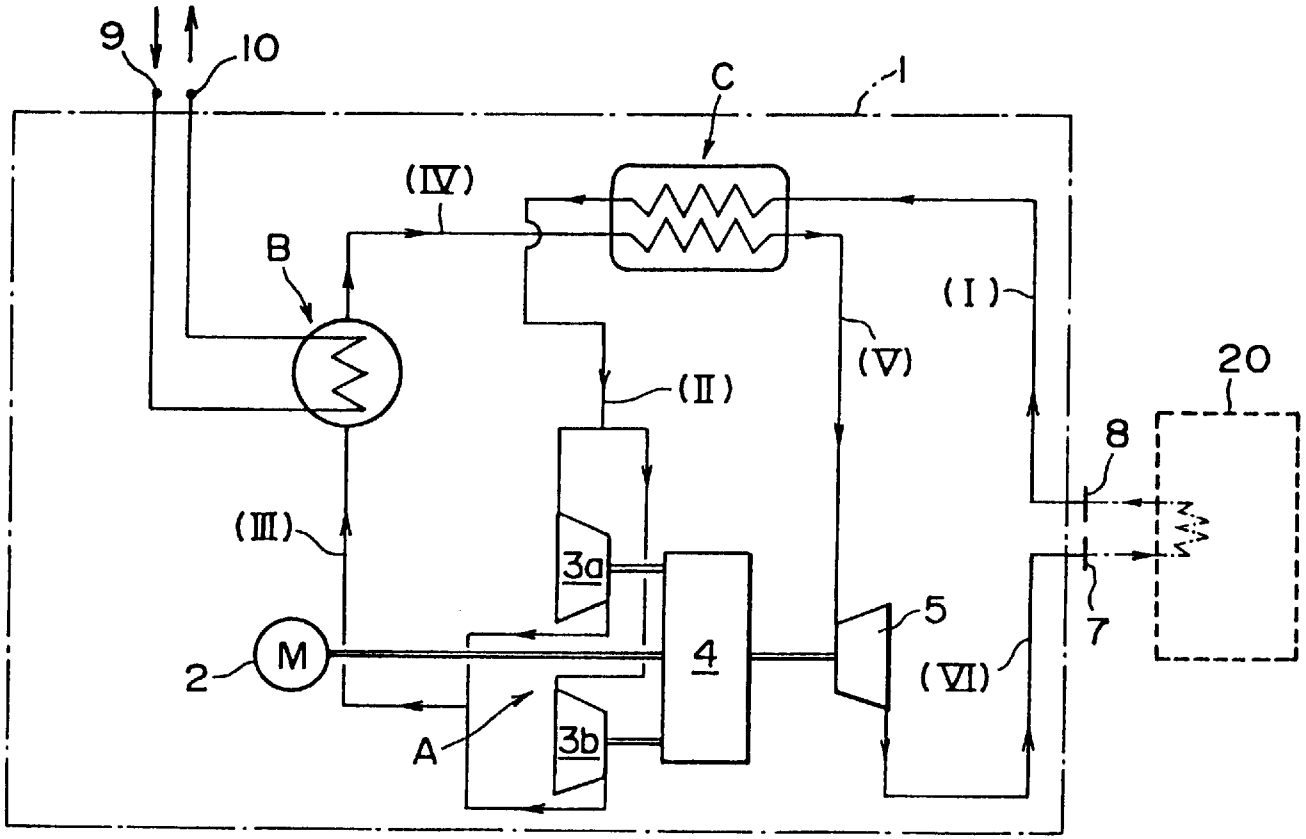
FIG. 3 is a component layout system diagram for explaining the operating mode of the invention unit.

FIG. 3 is a system diagram showing the air paths between the components still more schematically than in FIG. 2. The reference numerals have the same meaning as described above. The low-temperature air near atmospheric pressure flowing through the line (VI) when the unit is operated is conducted to a load 20 through an air path of required length connected to the cold air discharge connection 7. The return air from the load 20 is taken in through the line (I) through an air path of required length extending from the load side and connected to the return air intake connection 8. By this load is meant a facility that requires cooling. The low-temperature air produced by the unit can be used to cool the load indirectly via a heat exchanger or be used to cool the atmosphere of the load directly by blowing it directly into the atmosphere to be cooled. An example of the case where the atmosphere is that of a cold storage unit will be explained later with reference to FIGS. 16 and 17.

Figure 4:
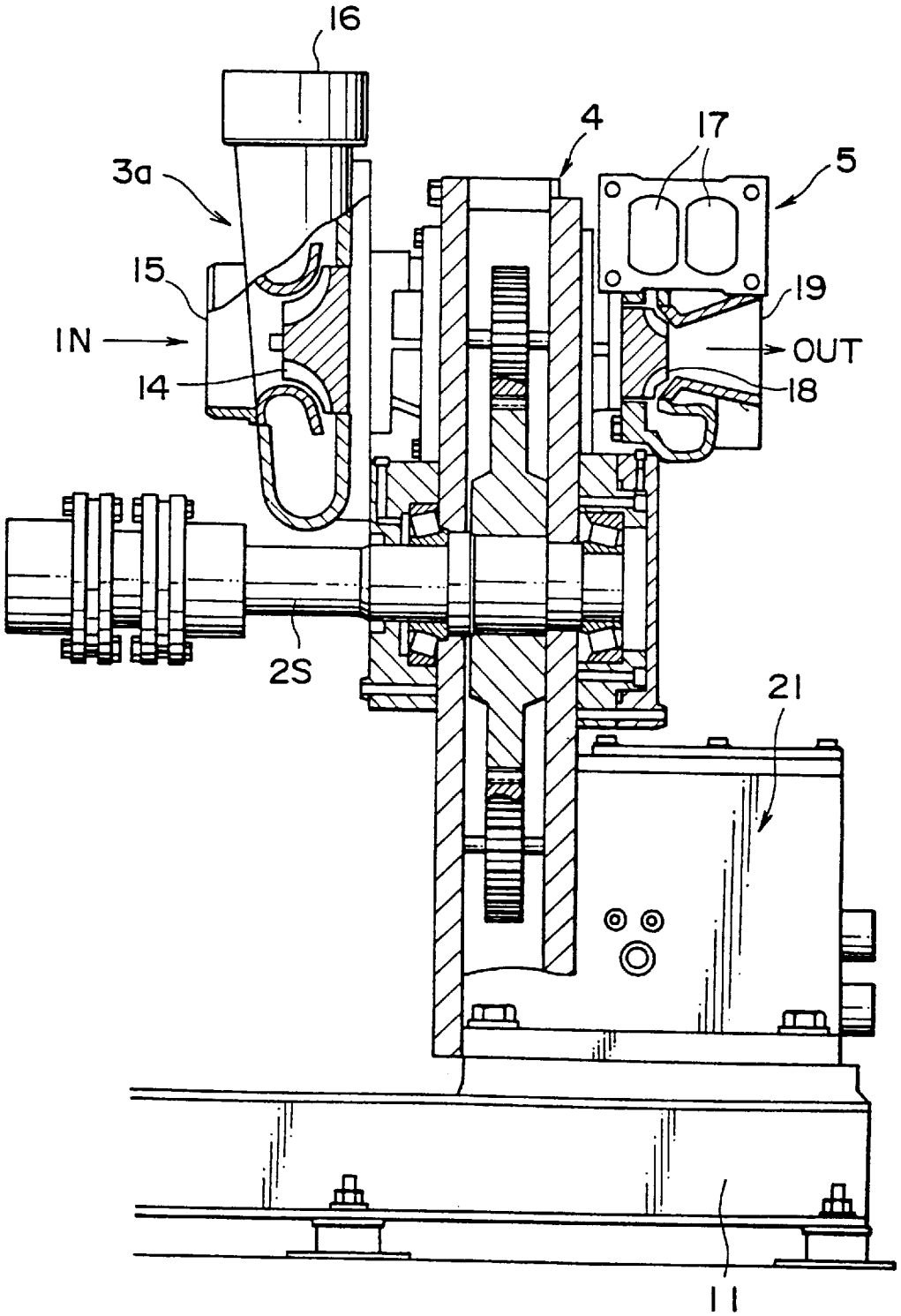
FIG. 4 is a partially cutaway sectional view of an integrated air compressor-expander used in the invention unit.
Figure 5:
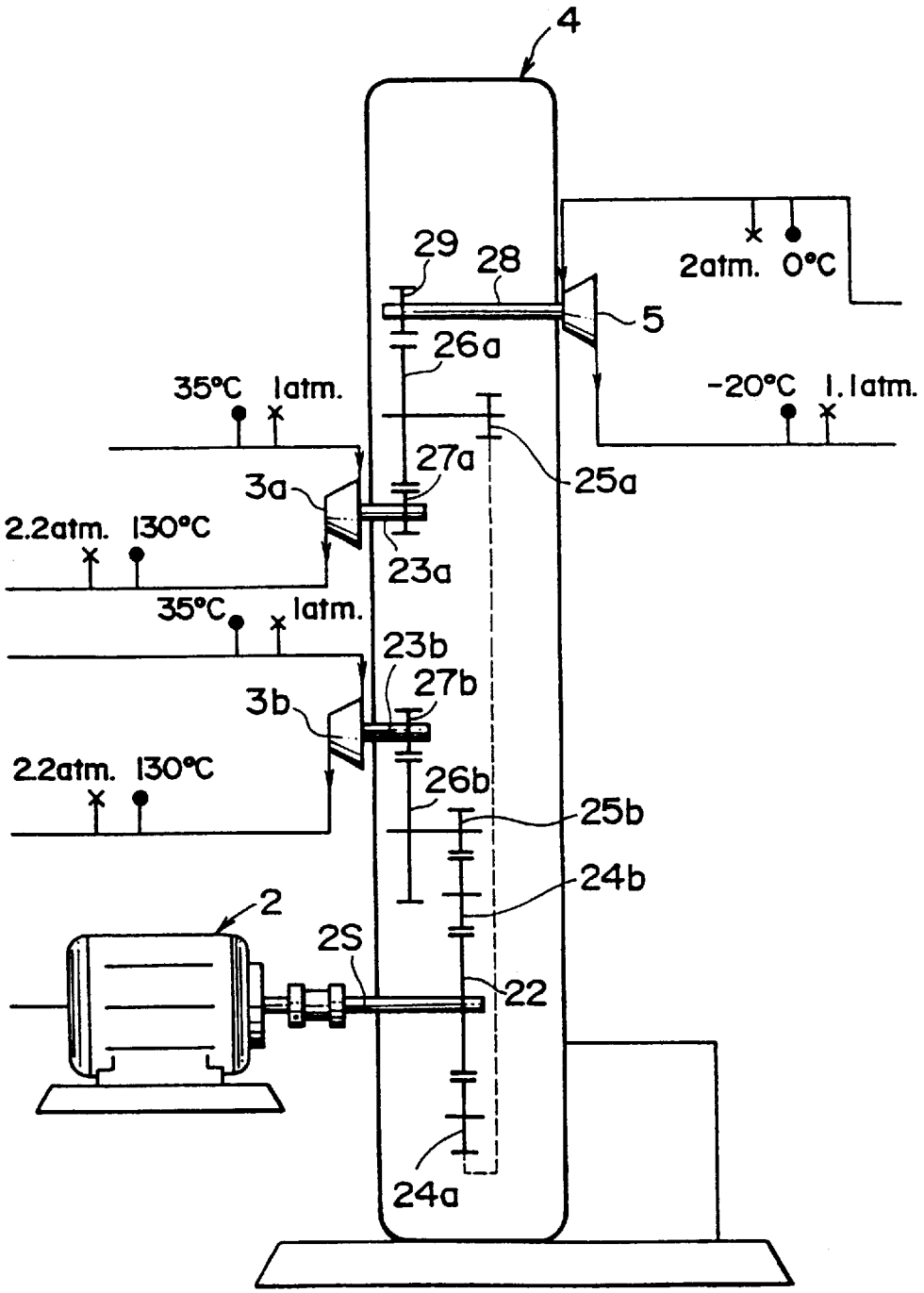
FIG. 5 is a diagram for explaining the gear chain in a gear box provided in association with the air compressor-expander of FIG. 4.

FIG. 4 is partially cutaway sectional view showing an example of the configuration of the air compressor-expander A provided in the unit. Another compressor 3*b* not visible in the drawing is located behind the compressors 3*a*. The shaft 2S of a motor (a squirrel-cage, three-phase induction motor; not shown) is connected through the gears of the gear box 4 with the shafts of the compressor 3 and the expander 5, as shown in FIG. 5 discussed later. The compressor 3 is a single-suction, single-stage blower turbocompressor consisting of two identical units connected in parallel. Each compressor is equipped with an impeller 14 rotated at high speed to suck in air through an inlet 15 in the body section, compress it and discharge it through an outlet 16. The expander 5 is a single-stage centrifugal turbine. Compressed air flowing into the expander 5 through an inlet 17 is adiabatically expanded to a normal pressure near atmospheric pressure and discharged from an outlet 19 while imparting rotational power to an impeller 18. Reference numeral 21 in FIG. 4 designates a lubricating oil unit for circulating lubricating oil for the shafts and gears.

FIG. 5 is a diagram illustrating the connection among the gears installed in the gear box 4. In the example shown, a main gear 22 on the shaft 2S of the motor 2 is connected with a shaft 23*a* of the compressor 3*a* through a speed-increasing gear chain 24*a*, 25*a*, 26*a* and 27*a*, and with a shaft 23*b* of the compressor 3*b* through a speed-increasing gear chain 24*b*, 25*b*, 26*b* and 27*b*. The two gear chains have the same gear ratio. The compressors 3*a*, 3*b* therefore rotate simultaneously at the same speed. On the other hand, a gear 29 fitted on the shaft 28 of the expander 5 is engaged with one gear 26*a* of the aforesaid gear chain. As a result, the shaft 2S of the motor, the shafts 23*a*, 23*b* of the compressors, and the shaft 28 of the expander form a linkage. By appropriately selecting the gear tooth ratio (gear ratio) between the gears, the work of the expander 5 when it adiabatically expands the compressed air supplied from the compressor to atmospheric pressure can be recovered as rotational power of the compressor. In the illustrated case, as indicated by the numerical values in the figure, the aforesaid gear ratio is designed such that when, for example, 35° C. air at 1 atm sucked into the compressor 3 is discharged therefrom as 130° C. air compressed to 2.2 atm and the total amount thereof is introduced to the expander at 2 atm and 0° C., it is adiabatically expanded to 1.1 atm and −20° C. The power recovery rate in this case reaches 42–45%. The rotational speed of the compressor impellers is about 40,000 rpm and that of the expander turbine is lower at about 30,000 rpm.

Thus the air compressor-expander A housed in the invention cold air supply unit integrates a motor, a compressor, a gear box and an expander, the compressor compresses air to a maximum of around 2.2 atm (in some cases, 2.0 atm or 1.8 atm), this air is introduced to the expander at a pressure close to the aforesaid pressure after being cooled to around 0° C., the rotational speed and the gear ratio is selected such that the expander adiabatically expands the air to atmospheric pressure, and the selected rotational speed and gear ratio enable a power recovery rate which reaches 50% at maximum and 42–45% ordinarily. As far as the inventors are aware, no such integrated air compressor-expander capable adiabatically expanding low-temperature compressed air to atmospheric pressure has ever been fabricated up to now.

While a consolidated unit using two compressors was indicated in the foregoing example, the integrated unit can instead be one that utilizes a single compressor. In this case it also possible to conduct air processing similar to that in the foregoing example. While an example using an electric motor as the power source was indicated, the power source can instead be an internal combustion engine.

The heat exchangers housed in the invention unit will be explained next. The compressed air discharged from the compressor 3 is first cooled by the air-to-water heat exchanger B and then cooled by the air-to-air heat exchanger C and introduced to the expander 5. As the air-to-water heat exchanger B there is used an ordinary fin-tube-plate heat exchanger, with the cooling water passed on the tube-plate side. As the air-to-air heat exchanger C, on the other hand, there is used one whose heat exchanger plates are made of a resin material.

Figure 6:
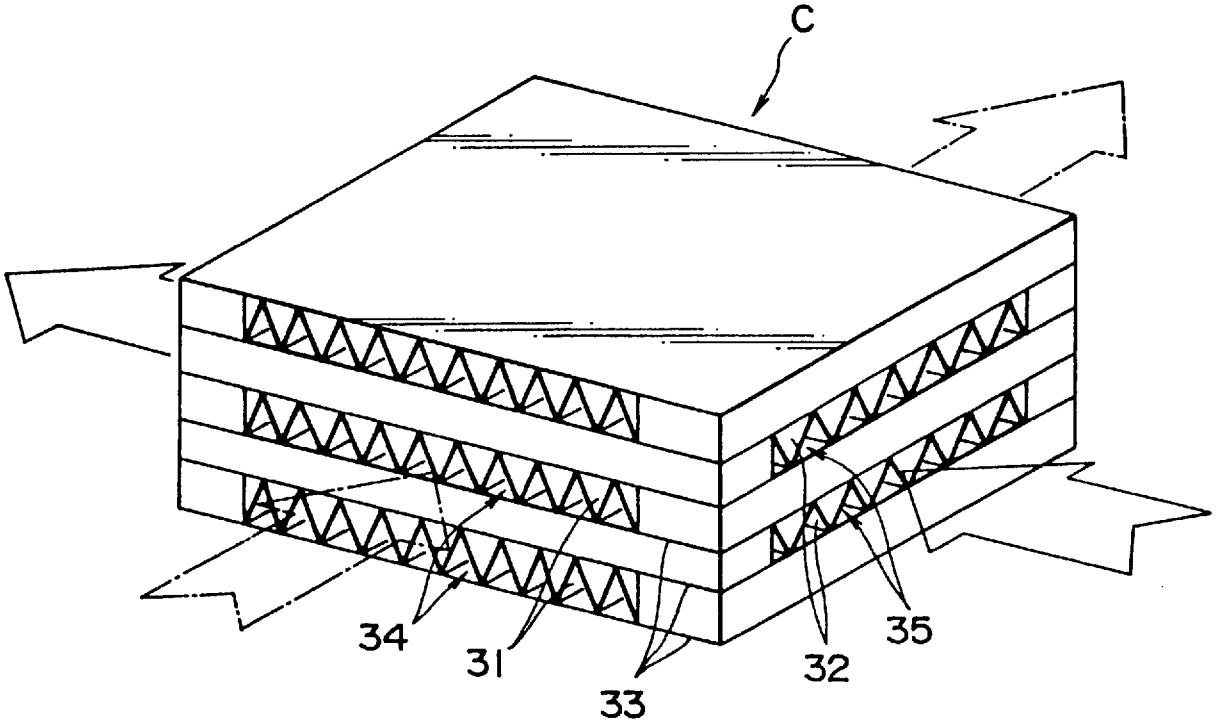
FIG. 6 is a perspective view showing an example of an air-to-air heat exchanger.

FIG. 6 is a schematic diagram illustrating the essential portion of the resin air-to-air heat exchanger C. As shown, this heat exchanger is a block consisting of corrugated resin plates 31, 32 stacked alternately with their wave lines at right angles and resin partitions 33 disposed between adjacent corrugated plates 31, 32. Since this configuration forms multiple air passages 34 between the corrugated plates 31 and the partitions 33 and, as separated therefrom by the partitions 33, air passages 35 alternate and perpendicular therewith between the corrugated plates 32 and the partitions 33, heat exchange between the two air flows can be achieved at high efficiency without air mixing by passing one air flow through the air passages 34 and the other air flow through the air passages 35.

The aforesaid cross-flow type resin air-to-air heat exchanger C can be replaced with one of the counterflow type or, in some cases, with one of the oblique-flow type.

Figure 7:
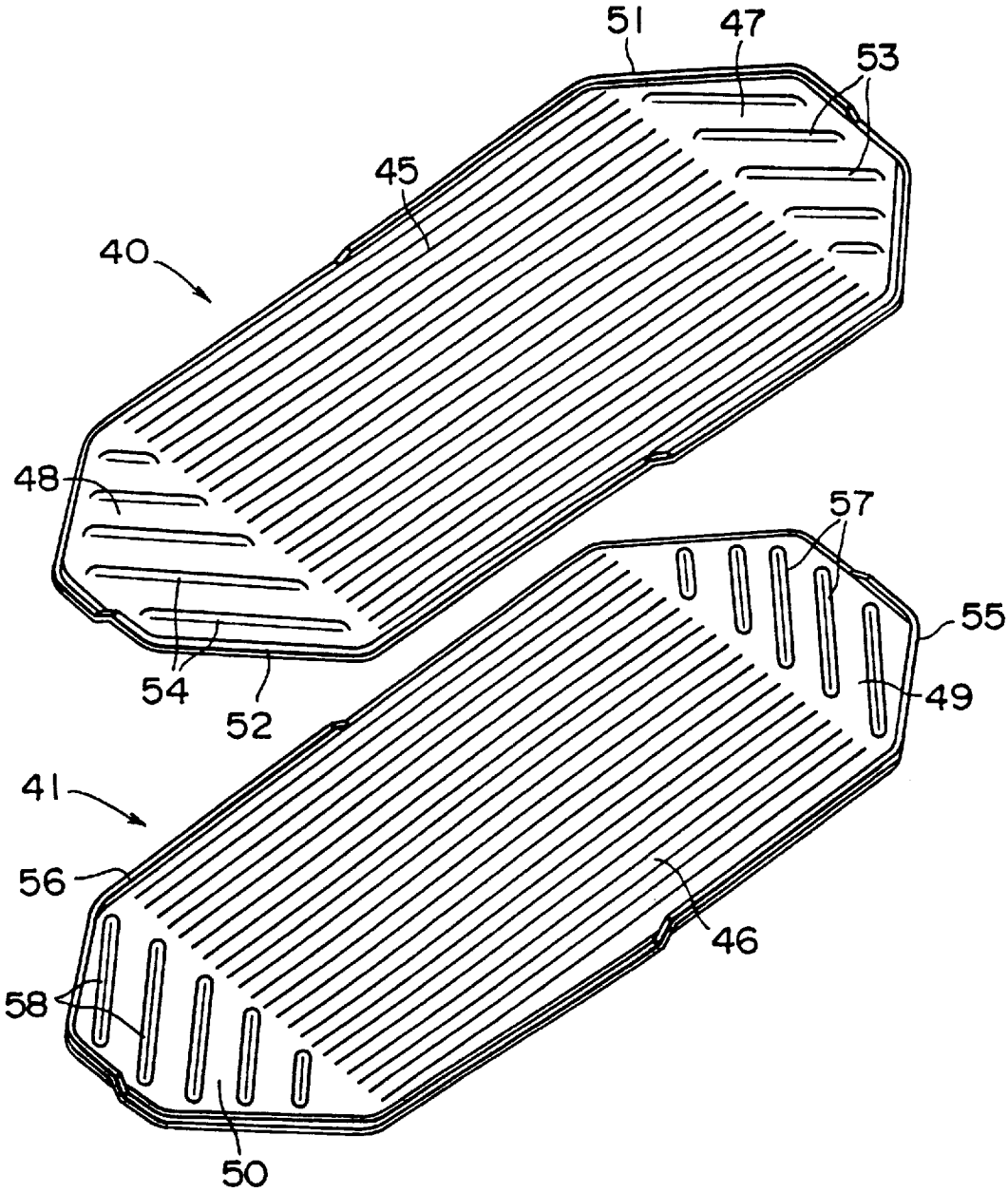
FIG. 7 is a perspective view showing examples of corrugated resin plates (partition plates) for configuring another example of the air-to-air heat exchanger.
Figure 8:
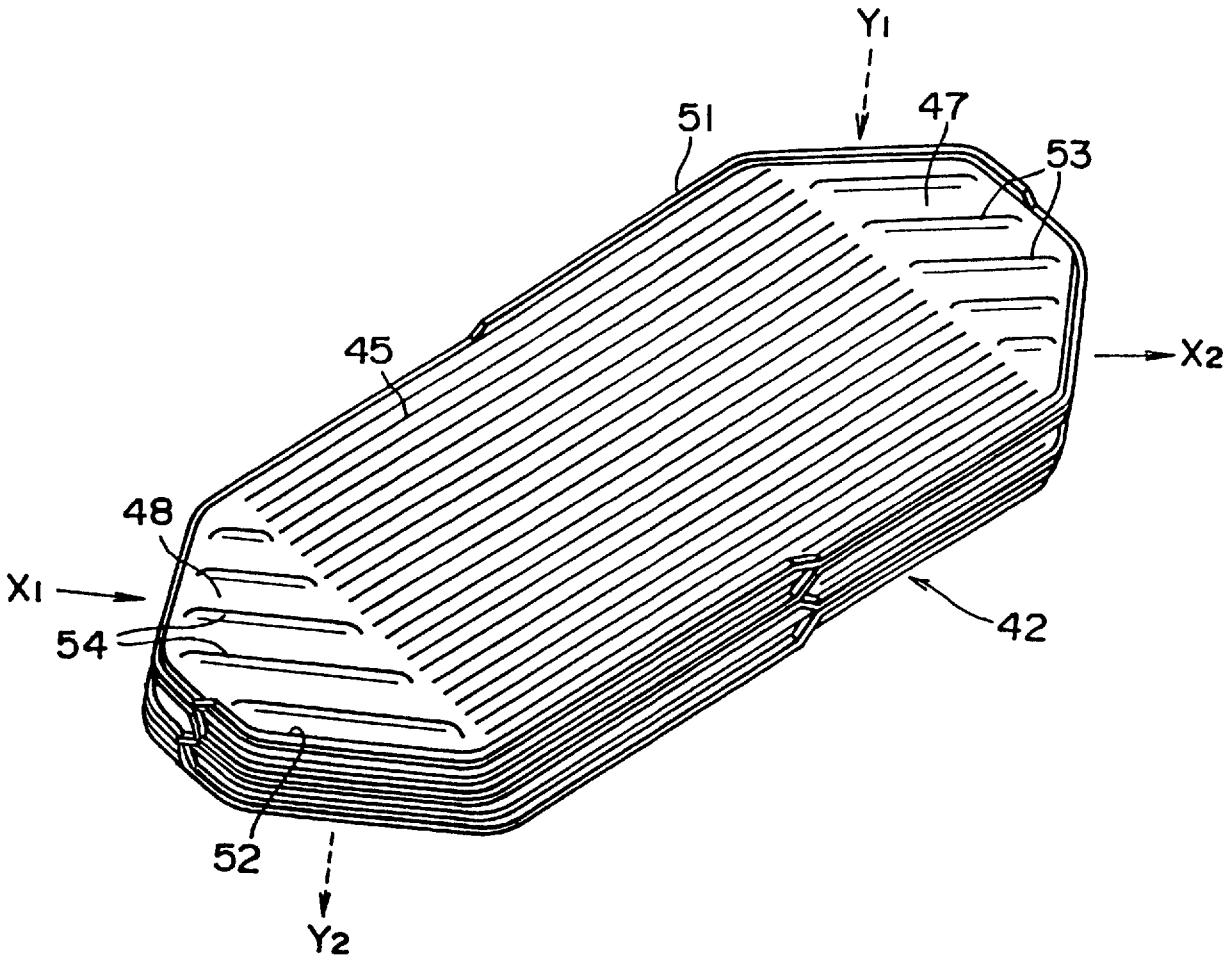
FIG. 8 is a perspective view illustrating how the first and second partition plates of FIG. 7 are alternately stacked.

FIGS. 7–14 show and example of a counterflow type air-to-air heat exchanger usable in the invention unit. It is produced by alternately stacking a large number of first partition plates 40 and second partition plates 41, both formed of resin as shown in FIG. 7, in their thickness direction as shown in FIG. 8, to obtain a heat exchange unit 42 and housing the heat exchange unit 42 in a casing 43 like that shown in FIG. 14 to obtain an air-to-air heat exchanger C(1).

Figure 10:
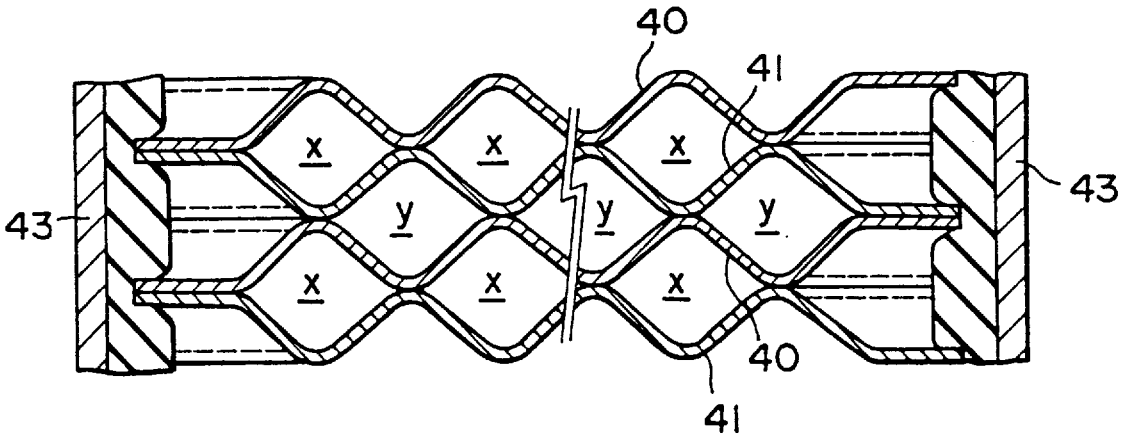
FIG. 10 is an enlarged sectional view of the stack (heat exchange unit) of FIG. 8 installed in a casing, as seen in the direction traversing the wave lines.

The partition plates 40 and 41 are thin plates of hard vinyl chloride having the same thickness and shape and have their heat exchange surfaces formed with waves so as to configure a large number of parallel straight fluid passages (called fine tubes) running in the direction of air flow. As shown in section in FIG. 10, in both plates 40 and 41 this wave configuration consists of regular waves having crest apex angles (valley included angles) of approximately 90° C., with the waves being inverted between the two plates in a symmetrical pattern. As a result, when the plates are alternately stacked with the straight bottom lines of the valleys of the first partition plate 40 and the straight ridge lines of the crests of the second partition plate 41 (and the straight bottom lines of the valleys of the second partition plate 41 and the straight ridge lines of the crests of the first partition plate) in contact with each other, many parallel fine tubes of approximately rectangular sectional shape (square with rounded corners) are formed between the partition plates 40 and 41 at every tier. In FIG. 10, when one fluid (e.g., high-temperature side air) is passed through all fine tubes (x) of a given tier formed between two plates and another fluid (e.g., low-temperature side air) is passed through all fine tubes (y) of the tier adjacent thereto with the two fluids being passed in opposite directions (counterflow), then in any given fine tube (x) or (y) the walls on all four sides of the rectangular constitute heat exchange surfaces with the other fluid.

Figure 11:
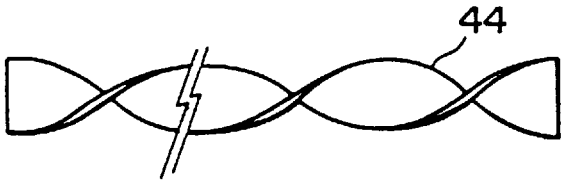
FIG. 11 is a front view showing a twisted tape for insertion into air passages x and y seen in FIG. 10.
Figure 12:
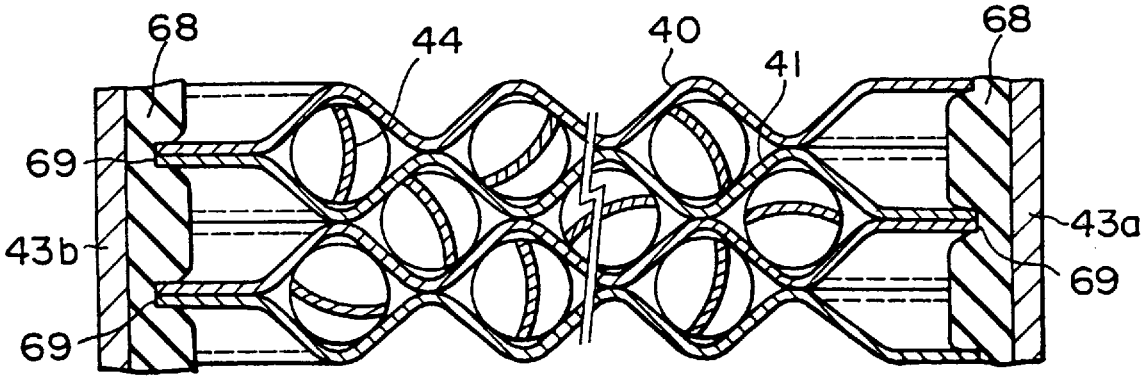
FIG. 12 is an enlarged sectional view similar to FIG. 10 showing the twisted tape of FIG. 11 inserted into the air passages of FIG. 10.

Twisted tapes (or ribbons) 44 like the one shown in FIG. 11 are inserted in substantially all of the fine tubes (x), (y). The width of the twisted tape 44 is such that when the twisted tape 44 is inserted into the air passage of approximately square sectional shape, it just makes contact with both the first partition plate and the second partition plate forming the fine tubes concerned. FIG. 12 shows twisted tapes 44 inserted in the fine tubes (x), (y) of FIG. 11. The insertion of the twisted tapes 44 into all of the fine tubes (x), (y) in this manner increases the heat exchange efficiency by producing turbulence in the fluid flowing through the passages and, moreover, the presence of the twisted tapes prevents the resin partition plates forming the fine tubes from being deformed, thus also preventing fluid leakage, even if some degree of pressure difference should be present between the one air flow and the other air flow.

The air-to-air heat exchanger C(1) is further configured to have a special seal structure for fixing the positions of the partition plates 40 and 41 with the edges of the plates in a tightly sealed state relative to the inner wall of the casing 43 and to have a special header structure for passing the first fluid and the second fluid in opposite directions through the fine tubes of each pair of adjacent tiers. These structures will now be explained with reference to the drawings.

As can be seen in FIG. 7, each partition plate 40 (other plate 41) comprises a rectangular corrugated heat exchange section 45 (46) for forming the aforesaid fine tubes, a flow regulating section 47 (49) extending outward from the rectangular heat exchange section at one end of the passages, and a flow regulating section 48 (50) extending outward at the other end of the passages. The flow regulating section 47

(49) and the flow regulating section 48 (50) are identically configured as truncated isosceles triangles tapering outward in the same plane as the corrugated heat exchange section 45 (46).

Focusing on the first partition plate 40, only one of the two equal sides of the flow regulating section 47 has a raised piece 51 covering the length thereof. In addition, multiple flow regulating fins 53 inclined in the same direction as the raised piece 51 are formed on the body section of the flow regulating or straightening section 47. The other flow regulating section 48 is similarly provided with a raised piece 52 and flow regulating fins 54 oriented in the same direction as those of the regulating section 47. The second partition plate 41 is similarly configured, but in its case the raised piece 55 of the flow regulating section 49 is provided on the other side from that of the first partition plate 40, the raised piece 56 of the flow regulating section 50 is provided on the other side from that of the first partition plate 40, and the flow regulating fins 57, 58 are inclined in the same direction as the raised pieces 55 and 56. In addition, each of the sides not provided with a raised piece is provided with a hanging piece so that when the first and second partition plates are stacked, the raised pieces on each plate and the hanging pieces on the other plate abut. As a result, shutter walls are formed at every other tier. Further, slit-like openings are formed between the shutter walls. This relationship is shown in detail in FIG. 9.

Figure 9:
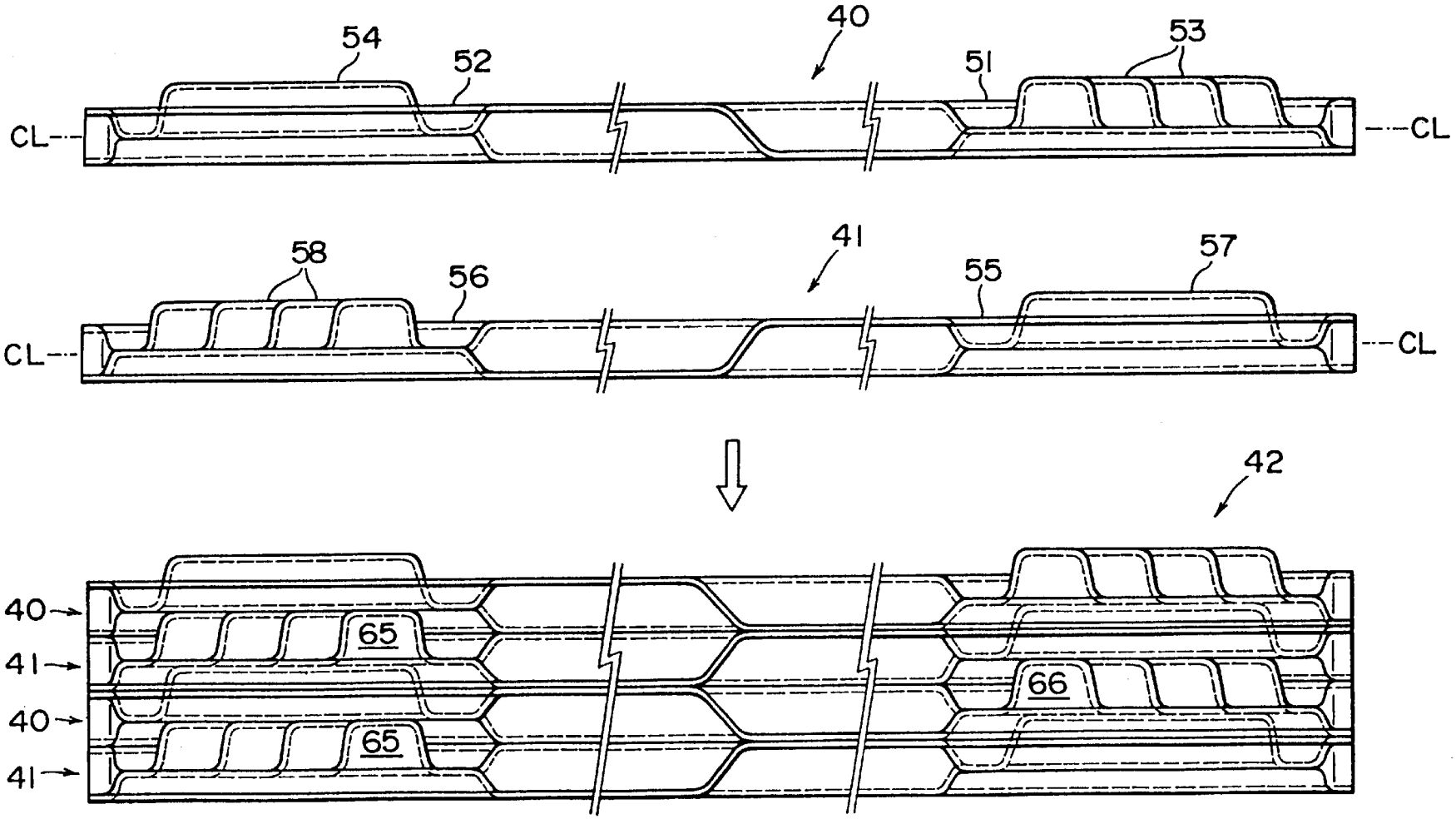
FIG. 9 is a side view seen from one side of the first partition plates and the second partition plates of FIGS. 7 and 8.
Figure 13:
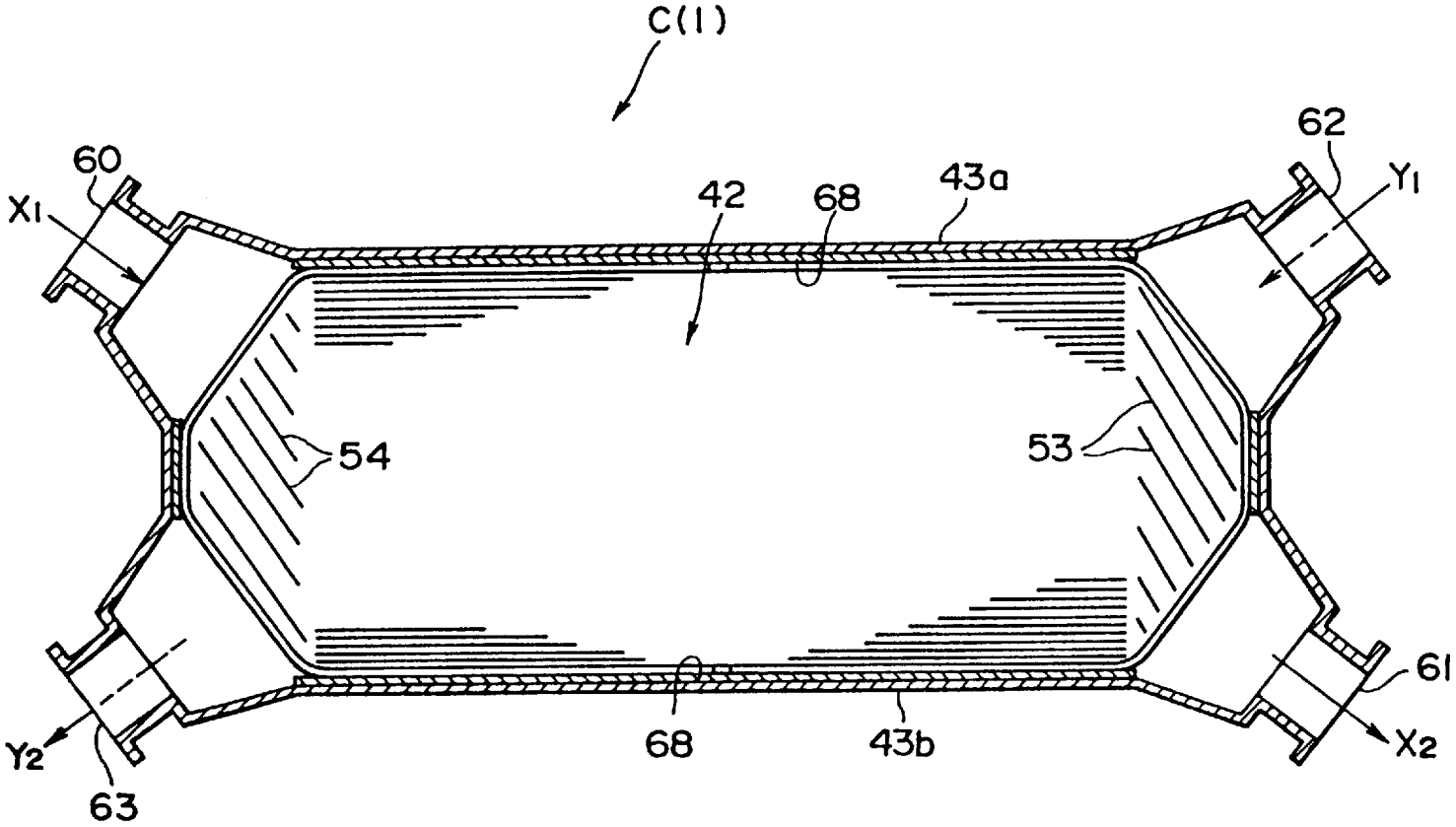
FIG. 13 is a plan sectional view showing how the stack of FIG. 8 is installed in the casing.
Figure 14:
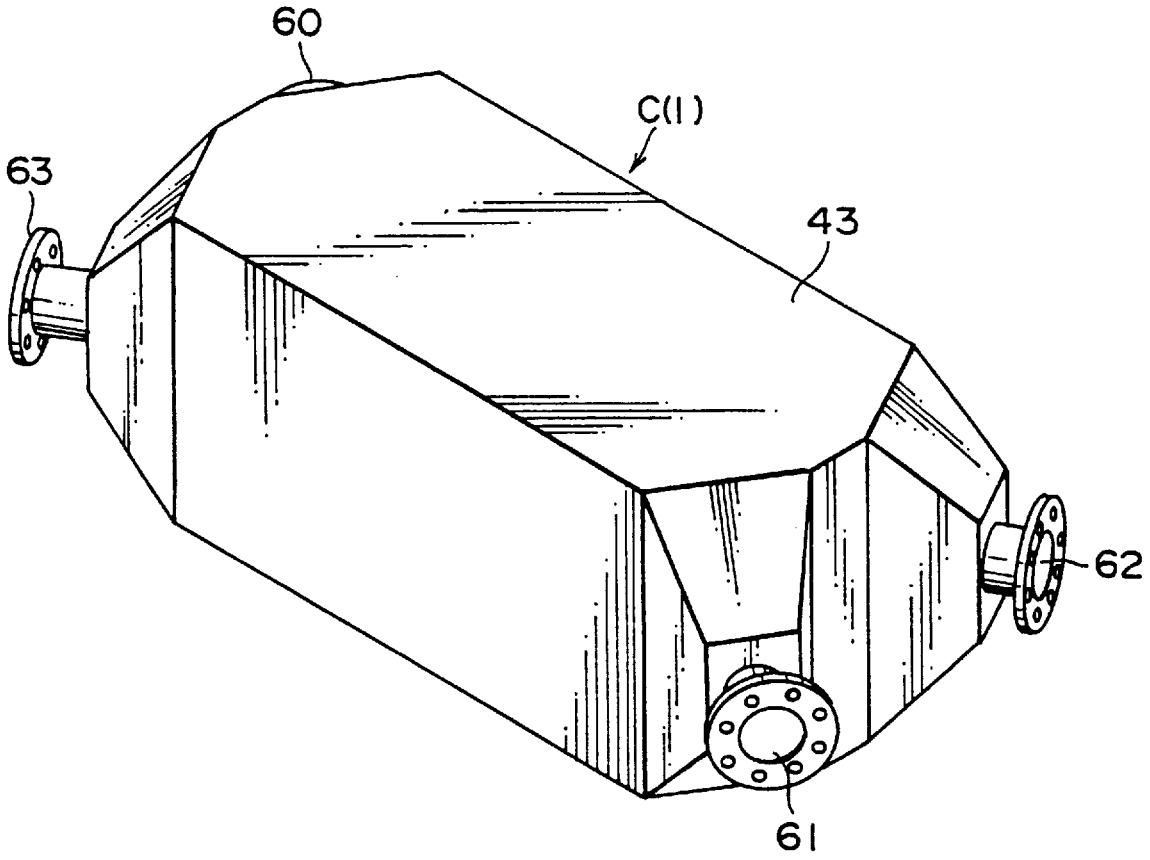
FIG. 14 is a perspective view showing the overall external configuration of the heat exchanger of FIG. 13.

Four of the first partition plates 40 and second partition plates 41 shown as separated from each other at the top of FIG. 9 are shown at the bottom in their alternately stacked condition. The reference numerals in the figure correspond to those referred to earlier. The reference levels of the plate surfaces of the partition plates 40 and 41 shown at the top are the levels of lines CL in the figure. In the stacked state at the bottom, a slit-like opening 65 is formed at every other tier in the flow regulating section on the left side of the side surface shown in the drawing and, similarly, a slit-like opening 66 is formed at every other tier in the flow regulating section on the right side. The openings 65 on the left side and the openings 66 on the right side are in alternate tiers. On the side surface opposite from that shown in the drawing, the tiers in which the slit-like openings appear are offset by one. Thus the heat exchange unit 42 constituted by alternating stacking the two types of plates is formed at either end of the rectangular box-shaped block forming the fine tubes with a triangular column-shaped block (a flow regulating header section) extending therefrom like the bow of a ship, and either side of each triangular column-shaped block is formed alternately in the direction in which the partition plates are stacked with slit-like open sections and closed sections closed by the raised pieces and hanging pieces. In addition, the open sections and the closed sections appear as offset by one tier on opposite side surfaces of the blocks. Therefore, when the first fluid is introduced from one side of the block in the direction indicated by the solid arrow $X_1$ in FIG. 8, the fluid passes into all of the open sections formed in every other tier on this surface, through the fine tubes of the individual tiers of the center block, and out in the direction indicated by the solid arrow $X_2$. On the other hand, when the second fluid is introduced from the direction indicated by the dashed arrow $Y_1$, it similarly flows out in the direction of the dashed arrow $Y_2$. In this case, the first fluid flows between the large number of partition plates at every other tier and the second fluid passes in counterflow through every other tier therebetween. As shown in FIGS. 13 and 14, the flows of the first fluid and the second fluid is actually conducted through flow ports 60, 61, 62 and 63 provided in the casing 43. As can be seen in FIG. 14, these ports are provided at air ducts whose end connections are of a size sufficient to cover the side areas of the triangular-shaped block of the heat exchange unit.

FIG. 13 is a plan sectional view showing the heat exchange unit 42 housed in the casing 43. In the illustrated example, the first fluid is introduced from the flow port 60 in the direction indicated by the arrow $X_1$ into all tiers of the set of alternate tiers including the tier between the partition plate appearing in the section (corresponding to the upper first partition plate 40 in FIG. 7) and the partition plate immediately above it (not visible in the drawing), passes through the fine tubes of these tiers and passes out through the flow port 61 in the direction indicated by the arrow $X_2$. On the other hand, the second fluid is introduced from the flow port 62 in the direction indicated by the arrow $Y_1$ into all tiers of the set of alternate tiers including the tier between the partition plate appearing in the drawing and the partition plate immediately below it (not visible in the drawing) (all tiers adjacent to the first fluid tiers), passes through the fine tubes of tiers and passes out through the flow ports 63 in the direction indicated by the arrow $Y_2$. At this time, the flow regulating fins 53, 54 (57, 58) produce a flow regulating action that uniformly distributes the fluid headed from the flow ports toward the large number of fine tubes of the tiers and an action of uniformly converging the flows of fluid headed from the fine tubes toward the flow ports. It will be understood that the directions of this flow regulating and flow converging cross each other in adjacent tiers. As a result, heat exchange is also conducted in the flow regulating section formed by the header section.

Moreover, in the air-to-air heat exchanger C(1), the follow technique is used regarding the manner of joining the heat exchange unit 42, which is a block of many stacked partition plates, and the casing 43. Namely, when the required number (e.g., 50–300) of identically shaped first partition plates 40 and second partition plates 41 are stacked to form the heat exchange unit 42 and the stack in this state is sandwiched from opposite sides between two plates forming the side surfaces of the casing (the plates indicated as 43*a* and 43*b* in FIGS. 12 and 13), a sheet-like seal material 68 exhibiting elasticity is disposed therebetween. Therefore, as can be seen in FIG. 12, the edges 69 of the partition plates elastically press into the thickness of the seal material 68, thereby fixing their positions and establishing a sufficient seal between the edges 69 of the partition plates and the casing side plates 43*a*, 43*b*. This seal structure formed with the casing inner wall surface by use of the seal material 68 can be adopted at all places where the edges of the partition plates are required to be air-tightly sealed with the casing inner wall surface. As the seal material 68 there can be used polyurethane resin having closed cells or various elastic (elastomer) plastic materials. A particular preferable material is an elongate sheet product of special foamed polyurethane available on the market under the tradename NIPPARON. This product is a thermosetting polyurethane resin sheet having a microcell layer in the middle and skin layers on both surfaces and was found to be suitable as the heat exchanger seal material 68, which requires elasticity and air tightness.

In summary, the air-to-air heat exchanger C(1) has a heat exchange unit formed by alternately stacking multiple first partition plates and multiple second partition plates in their thickness direction, thereby alternately forming between the partition plates first flow paths for passage of a first fluid and second flow paths for passage of a second fluid, and a casing for housing the heat exchange unit, and is characterized in that the casing is provided with at least one pair of first fluid flow ports for passing the first fluid and at least one pair of second fluid flow ports for passing the second fluid, each first partition plate is provided with a corrugated heat exchange section constituted of crests and valleys extending in the direction of fluid flow, each second partition plate is also provided with a corrugated heat exchange section constituted of crests and valleys extending in the direction of fluid flow, a large number of sectionally rectangular flow path spaces usable as the first flow paths and the second flow paths are formed in parallel between the partition plates by aligning the tips of the crests and the tips of the valleys of the partitions, the ends of each partition plate on the sides facing the first fluid flow ports are shaped to be open for communicating the first flow paths with the first fluid flow ports and shaped to close the second flow paths off from the first fluid flow ports, the ends of the each partition plate on the sides facing the second fluid flow ports are shaped to be open for communicating the second flow paths with the second fluid flow ports and shaped to close the first flow paths off from the second fluid flow ports, and a seal is established between the edges of the partition plates and the inner surface of the casing by interposing a sheet-like seal material between the edges of the partition plates and the casing at all places except the fluid flow ports.

Figure 15:
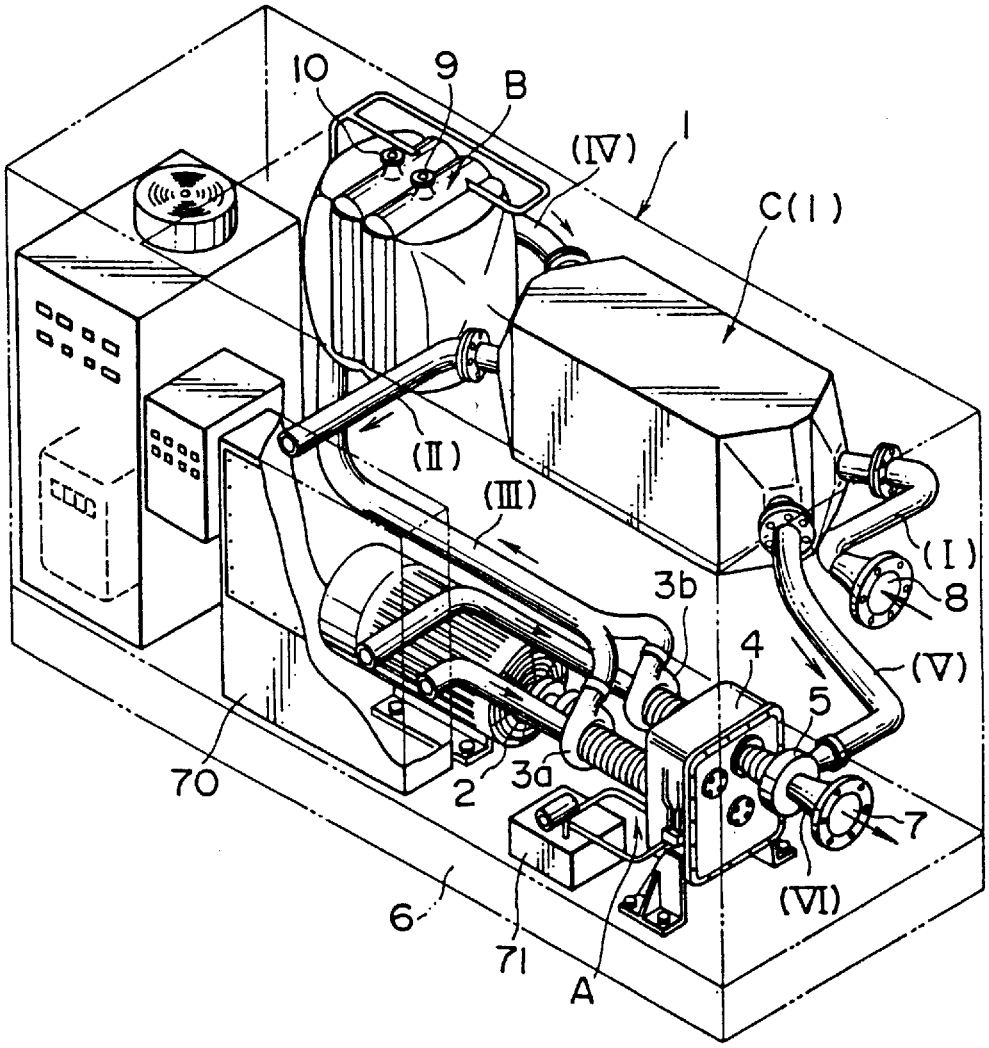
FIG. 15 is a perspective view of an embodiment of the cold air supply unit according to the invention equipped with the heat exchanger C(1) of FIG. 14.

FIG. 15 is a perspective view of an invention cold air supply unit which uses the heat exchanger C(1) explained in the foregoing as its air-to-air heat exchanger. The reference symbols in FIG. 15 which are the same as those in FIG. 1 represent the same members as those in FIG. 1. The lines (I), (II), (III), (IV), (V) and (VI) shown in FIG. 15 correspond to those explained regarding FIGS. 2 and 3. The unit of FIG. 15 differs from that of FIG. 1 not only in its use of the air-to-air heat exchanger C(1) but also in the point of the depicted filter box 70 and lubricating oil unit 71. In the illustrated example, the filter box 70 is inserted in the line (II) between the point where the air exits from the air-to-air heat exchanger C(1) and the point where it is sucked into the compressors 3*a*, 3*b*. The filter box 70 filters dust from the air and, in some cases, may be equipped with a dehumidifying and/or defrosting device. The lubricating oil unit 71 is provided for circulating lubricating oil through the gearing and bearings in the gear box 4 and is equipped with an oil tank and a pump. The cold air supply unit of FIG. 15 utilizing the air-to-air heat exchanger C(1) plays an important role in achieving the aforesaid object of this invention.

The first and second partition plates of the air-to-air heat exchanger C(1) described in the foregoing are made of hard vinyl chloride. Since the temperature and pressure of the air passing through this heat exchanger of the invention unit are not extreme, however, various resins able to withstand the conditions are commercially available. The use of such a resin plate-type heat exchanger enables the invention unit to fully achieve the required heat exchange performance, while also enabling the invention unit to be made low in cost and light enough in weight to be mobile.

Figure 16:
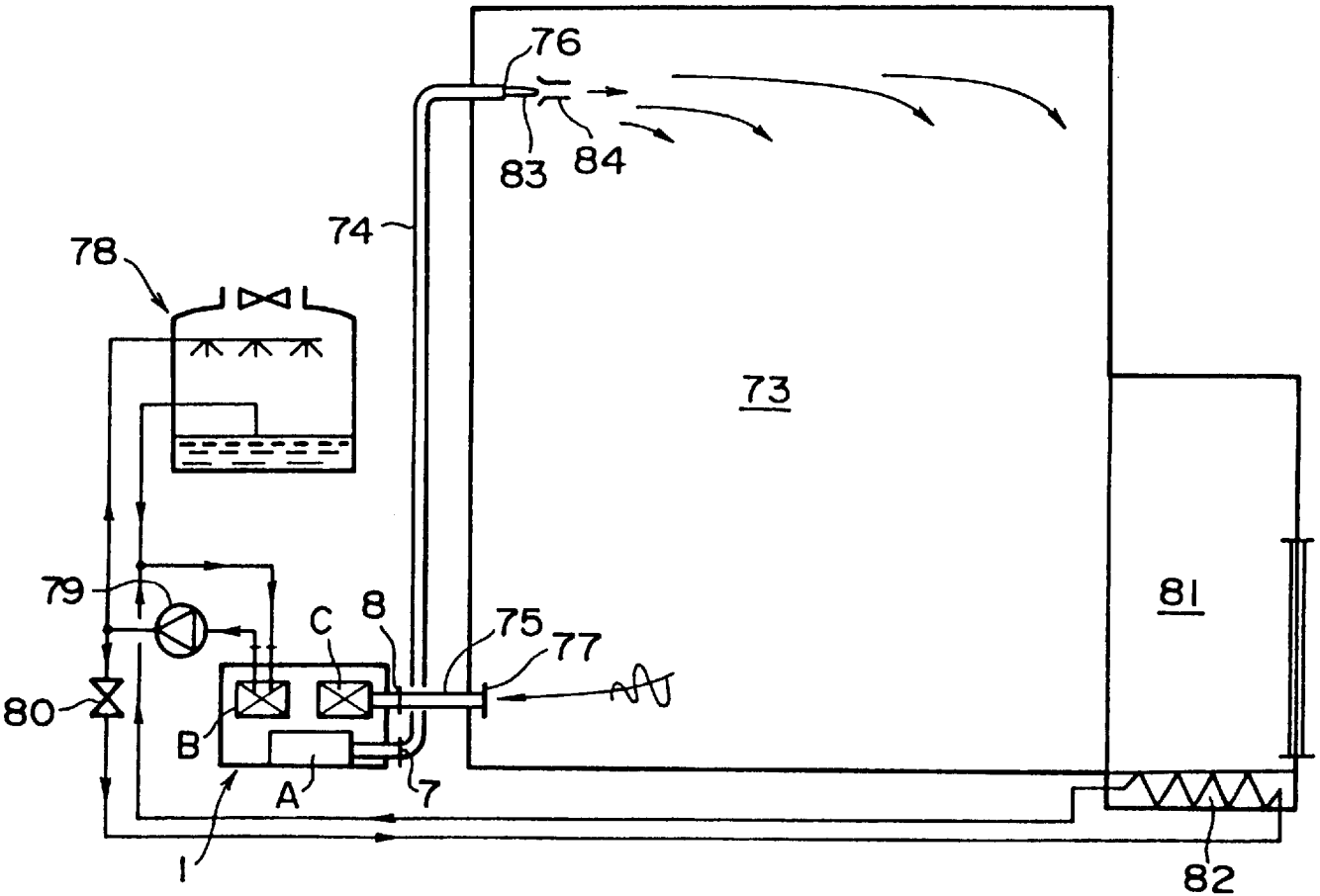
FIG. 16 is a simplified sectional view showing an example of a cold storage unit utilizing the unit of this invention.

FIG. 16 shows an example of the use of the cold air supply unit of this invention, namely, an example in which the unit 1 is installed outside a refrigerated storage unit chamber (the closed space 73 shown in the figure) in which it is desired to establish a low-temperature environment and the chamber is formed into a cold storage unit by installing an air feed pipe 74 and an air return pipe 75 between the unit 1 and the chamber 73. The air feed pipe 74 supplies low-temperature air from the unit 1 to the chamber 73 and is connected at one end to the aforesaid cold air discharge connection 7 of the unit 1 and at the other end to a cold air discharge port 76 installed near the ceiling of the chamber 73. The air return pipe 75 is a line for returning air in the chamber 73 to the unit 1 and is connected at one end to a suction port 77 provided at the lower part of the chamber interior and at the other end to the return air intake connection 8 of the unit 1.

On the other hand, cooling water is passed through the air-to-water heat exchanger B of the unit 1. In the illustrated example, the cooling water is cooled in a cooling tower 78 and circulated for reuse. More specifically, water piping is provided for circulating the cooling water between the cooling tower 78 and the air-to-water heat exchanger B by use of a pump 79. A part of the cooling water that has passed through the air-to-water heat exchanger B of the unit 1 is passed through a control valve 80 and circulated through an ice-melting heat exchanger 82 installed under the floor of an entrance chamber 81 to the refrigerated chamber. When the cooling water exiting the air-to-water heat exchanger B is passed through the ice-melting heat exchanger 82, the water which was increased in temperature in the air-to-water heat exchanger B prevents ice from forming on the floor of the entrance chamber 81 or melts any that has already formed.

Figure 17:
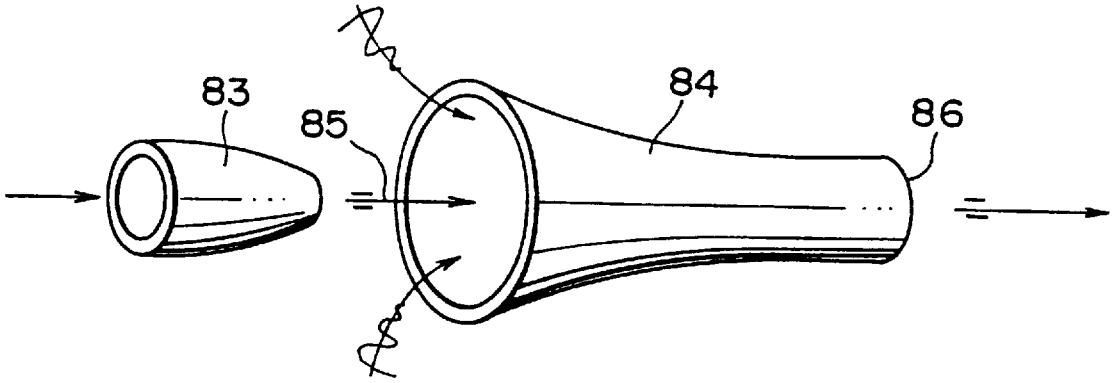
FIG. 17 is a perspective view showing an example of an ejector used in the cold air discharge port in FIG. 16.

FIG. 17 shows an air ejector suitable for use when low-temperature air produced by the unit 1 is blown into the chamber. This air ejector comprises an air discharge nozzle 83 and an induction nozzle 84 mounted concentrically with the nozzle at a prescribed distance from the tip thereof. The induction nozzle 83 is bell-mouthed and is mounted with its large diameter port side facing the air discharge nozzle 83. When this air ejector is used, the jet stream of low-temperature air 85 discharged from the air discharge nozzle 83 toward the induction nozzle 84 exhibits an action of inducting surrounding air at the time it passes into the induction nozzle 84. The jet stream 85 therefore enters the induction nozzle 84 while merging with higher temperature surrounding air so that a mixture of low-temperature air and surrounding air is discharged from the mouth 86 of the induction nozzle 84. As a result, the discharged low-temperature air and the surrounding air are efficiently mixed and the temperature of the member constituting the cold air discharge port is prevented from becoming extremely low. Since the fact that the temperature of the discharge port member does not become extremely low prevents accretion of ice or water on this member, the low-temperature air can be stably discharged over long periods. The cold air discharge port 76 in FIG. 16 is fitted with this type of ejector. The configuration of the ejector is not limited to that shown in FIG. 17. In general, when air is blown as a jet stream from an air nozzle having a tapered bore into a space under atmospheric pressure, an action occurs whereby the air present near the jet stream is inducted into the jet stream and carried a long distance. By utilizing this principle, it is possible even with a small amount of low-temperature air to lower the temperature of the chamber by dispersing and mixing the low-temperature air into/with the surrounding air. Moreover, by producing this dispersion and mixing at the top of the chamber, it is possible to cause masses of low-temperature air to descend spontaneously, thereby enabling a low-temperature environment to be established throughout the chamber by convection.

When, for instance, the unit 1 discharges air at about 1.1 atm and −20° C. through the ejector, a mixed air flow of this −20° C. air and surrounding air is discharged into the chamber. Cold air masses are thus continuously formed in the upper region of the refrigerated chamber 1 and these cold air masses successively descend to produce a low-temperature environment throughout the chamber. On the other hand, a quantity of air substantially corresponding to the amount of discharged air returns to the unit 1 from the suction port 77 through the air return pipe 75. The "cold" of this returning air is used in the air-to-air heat exchanger C to cool the compressed air before it enters the expander.

The energy for conveying the low-temperature air through the air feed pipe 74 and the energy for conveying the return air through the air return pipe 75 is all supplied by the air compressor-expander A in the unit 1 and is ordinarily sufficient for conducting the air supply and return. In cases where an unexpected pressure loss occurs because the facility requires long feed and return pipes or owing to frost removal or snow removal, however, the required amount of additional air-conveyance energy can be supplemented by inserting a blower in the feed/return line.

The invention unit is usable not only for constituting a refrigerated storage unit like that in FIG. 16 but also for other purposes. The unit can be operated anywhere that water and electricity are available or, if an engine is used as the motor, anywhere that water alone is available. Because of this and the fact that it is a portable self-contained stand-alone unit, it can be applied at various facilities requiring low-temperature air including, for example, leisure and sports facilities, at factories and buildings for air conditioning, and as an ice-making apparatus. It can also be used, for instance, to make ice for ice rinks and to construct bobsleigh and luge courses.

Taking as an example the case of an invention unit with a cooling capacity of 10 tons of refrigeration and operating under the conditions of an external air temperature of 30° C. and a discharged cold air temperature and air flow of −20° C. and 1.5 kg/sec, the processing states at the individual components expressed in terms of the temperatures and pressures at the lines (I)–(VI) in the figures are as set out below. (Provided that the temperature of the return air from the load side is assumed to be −5° C.)

| Location of air flow in unit | Air temperature (°C.) | Air pressure (atm) |
|---|---|---|
| Line (I) | −5 | 1.02 |
| Line (II) | +35 | 1.0 |
| Line (III) | +128 | 2.06 |
| Line (IV) | +40 | 2.05 |
| Line (V) | 0 | 2.04 |
| Line (VI) | −20 | 1.1 |

As shown, the invention unit is characterized in the point that the air treatment is conducted at relatively low pressure. The invention unit thus fully satisfies the conditions of safety, light weight and low cost required of a general-purpose low-temperature air production apparatus. In addition, it easy to fabricate, and simple to transport and install.

We claim:

1. A cold air supply unit housed in a casing, comprising:

an air compressor-expander unit comprised of a combination of a motor, an air compressor and an air expander;

an air-to-water heat exchanger which is connected with a cooling water intake connection and a cooling water outlet connection;

an air-to-air heat exchanger;

the air compressor, the air expander, the air-to-water heat exchanger, and the air-to-air heat exchanger, being disposed in the casing;

air tubing for interconnecting the air compressor, the air expander, the air-to-water heat exchanger, and the air-to-air heat exchanger, so that air at an air pressure not higher than 5 kg/cm$^2$, is transmitted therebetween, said air tubing further communicating with a cold air discharge connection, and a return air intake connection.

2. A cold air supply unit according to claim 1, wherein the air compressor-expander unit is an integrated unit comprising: a single motor, at least one multiple single-suction, single stage blower turbocompressor type air compressor, a gear box, and a single single-stage centrifugal turbine air expander, and wherein a shaft of the single motor is connected at different gear ratios through gearing in the gear box, with a drive shaft of the air compressor and a shaft of the air expander, respectively.

3. A cold air supply unit according to claim 2, wherein the air compressor comprises at least one single-suction, single stage blower.

4. A cold air supply unit according to claim 1, wherein the air-to-air heat exchanger comprises a plurality of stacked corrugated resin plates which have resin heat exchanging surfaces, the air-to-air heat exchanger being arranged so that a first air flow passes through a first plurality of air passages formed between adjacent corrugated plates of the stack and a second air flow passes through a plurality of second air passages adjacent the first air passages.

5. A cold air supply unit according to claim 4, wherein the corrugated resin plates are stacked so as to form a plurality of fine air passages therebetween.

6. A cold air supply unit according to claim 5, wherein the corrugated resin plates are installed in a heat exchanger casing with an elastic resin sheet interposed between the stacked corrugated resin plates and an inner surface of the heat exchanger casing.

7. A cold air supply unit according to claim 5, wherein twisted tapes extend along the fine air passages and cause turbulence which increases heat exchanging efficiency.

8. A cold air supply unit which comprises, as housed in a single casing, an air compressor-expander constituted of an integral combination of a motor, an air compressor and an air expander, an air-to-water heat exchanger and an air-to-air heat exchanger, is furnished in the casing with air tubing for interconnecting the air compressor, the air expander, and the air-to-water heat exchanger at an air pressure not higher than 5 kg/cm$^2$, and is provided with a cold air discharge connection, a return air intake connection, a cooling water outlet connection and a cooling water intake connection;

wherein the air-to-air heat exchanger is a heat exchanger which is constituted by stacking a large number of corrugated resin plates and has resin heat exchanging surfaces, one air flow being passed through air passages formed between adjacent corrugated plates of the stack and another air flow being passed through air passages adjacent to these air passages;

wherein the stack of corrugated resin plates is stacked with wave lines of the corrugated plates forming a large number of fine air passages between the wave lines; and wherein the fine air passages are formed as passages of approximately square sectional shape and twisted tapes are inserted in the passages.

9. A cold air supply unit comprising:

an air compressor-expander unit comprised of a motor driven air compressor, an air expander, and a drive connection means operatively interconnecting said air expander and said air compressor for transferring rotational energy from said air expander to said air compressor, said air compressor being adapted to supply an air pressure not higher than 5 kg/cm$^2$;

an air-to-water heat exchanger through which cooling water is adapted to flow, said air-to-water heat exchanger being arranged to received pressurized air from said compressor; and an air-to-air heat exchanger having a first plurality of passages through which a first flow of air from said air-to-water heat exchanger passes en route to said air expander, and a second plurality of passages which are in a heat exchange relationship with the first plurality of passages and through which air from an induction port passes en route to said air compressor.

10. A cold air supply unit according to claim 9, wherein said air-to-air heat exchanger comprises a stack of corrugated resin plates which have resin heat exchanging surfaces, the corrugated resin plates being so configured and arranged as to define and separate the first plurality of passages and the second plurality of passages.

11. A cold air supply unit according to claim 10, wherein the first plurality of passages and the second plurality of passages each have an essentially square configuration and each have a helically twisted tape disposed therein to create turbulence in the flow of air passing therethrough and to increase the heat exchange efficiency of the air-to-air heat exchanger.

12. A cold air supply unit according to claim 11, wherein the twisted tapes which are disposed in the passages contact the walls of the passage structures in which they are disposed and increase the structural rigidity of the structure which defines the first and second plurality of passages.

* * * * *